United States Patent [19]

Yamauchi

[11] 3,931,886

[45] Jan. 13, 1976

[54] INNER BAG FOR CONTAINERS

[76] Inventor: Akira Yamauchi, 121, Tatsumachi, Sasayamo-cho, Taki, Hyogo, Japan

[22] Filed: Dec. 16, 1974

[21] Appl. No.: 532,857

Related U.S. Application Data

[63] Continuation of Ser. No. 358,282, May 8, 1973, abandoned, which is a continuation of Ser. No. 125,188, March 17, 1971, abandoned.

[30] Foreign Application Priority Data

Mar. 17, 1970 Japan ..... 45-25737

[52] U.S. Cl. ..... 206/390; 215/11 R; 229/53

[51] Int. Cl.[2] ..... B65D 33/14; B65D 85/67; A61J 9/00

[58] Field of Search ..... 206/390; 229/53

[56] References Cited

UNITED STATES PATENTS

| | | | |
|---|---|---|---|
| 144,238 | 11/1873 | Stow | 229/53 |
| 2,628,013 | 2/1953 | Vogt | 229/53 |
| 2,907,485 | 10/1959 | Lunden | 215/11 R |
| 3,204,855 | 9/1965 | Boynton et al. | 229/53 |
| 3,254,828 | 7/1966 | Lerner | 229/53 |

*Primary Examiner*—Leonard Summer

*Attorney, Agent, or Firm*—Armstrong, Nikaido & Wegner

[57] ABSTRACT

An elongated flexible tube is formed with a plurality of sealing lines transversely of the tube in spaced apart relationship, a discontinuous cut line in the middle of each of the sealing line transversely of the tube and a discontinuous cut line in the shape of a continuous wavelike curve positioned transversely of the tube at the middle of the portion defined by each two adjacent sealing lines. The wavelike cut line defines at least two crest portions at the opening of each of a pair of inner bags to be formed on the opposite sides of the wavelike cut line. The inner bags, thus formed in a great number in a continuous tubular arrangement, can be separated along the cut lines for use.

4 Claims, 4 Drawing Figures

INVENTOR

BY

ATTORNEY

INNER BAG FOR CONTAINERS

This is a continuation of application Ser. No. 358,282, filed May 8, 1973, which is a continuation of application Ser. No. 125,188, filed Mar. 17, 1971, both abandoned.

The present invention relates to an inner bag for containers, more particularly to improvements in a flexible tubular bag to be used in the interior of a container such as a nursing bottle with its opening portion fastened to the mouth of the container.

In recent years, disposable inner bags such as of a thin polyethylene sheet have been introduced into a wide use for nursing bottles of a certain type. However, since these inner bags already known have generally been made individually one by one, they are inconvenient to carry about or to keep for storage. Moreover, the linear edge defining the opening of the known bag of this type makes it difficult to fold the opening portion over the mouth of a bottle and the outwardly folded portion which is always gathered together in wrinkles over the external wall surface of the bottle mouth gives rise to another difficulty that when the opening is to be fastened to the mouth by a nipple holding ring or the like externally mounted thereon, screw-thread engagement of the ring with the mouth can not be readily effected or the bag may be turned together with the holding ring, this making it impossible to fix the bag in position.

A primary object of the present invention is to provide an inner bag having an opening defined by a continuous wavelike curve which provides two to six crest portions at the opening so as to give the opening an elongated periphery effective for folding, the bag thus being adapted to be folded over the mouth of a container with extreme ease.

Another object of the present invention is to provide an inner bag formed with a wavelike peripheral edge at its opening as described above so that when the opening of the bag is folded over the mouth of a container such as nursing bottle and is to be fitted around the mouth by a fastening member like a nipple holding ring, the crest portions at the opening of the bag extending downwardly over the shoulder of the bottle can be held against the bottle by the finger to retain the opening against the rotation of the fastening member, the inner bag thus being adapted to be held in place in stable manner all the time.

Another object of the present invention is to provide an inner bag of the type described which is formed in a plurality of pairs which are continuous in the form of an elongated tube, the inner bags in each pair having wavelike openings thereof disposed in meshing arrangement with each other and adapted to be torn off from each other, so that a great number of the bags can be rolled up in a compact shape for storage as well as for carrying about and can be manufactured economically without resulting in waste of material.

Still another object of the present invention is to provide an inner bag which is sanitary and can be stored almost free from germs or dust which would otherwise get in through the opening.

In accordance with the present invention, a plurality of inner bags for a container are formed in pairs which are continuous in the shape of an elongated flexible plastic tube by forming in the tube a plurality of sealing lines disposed transversely of the tube and spaced apart by a predetermined distance longitudinally of the tube, a discontinuous cut line disposed in the middle of each of the sealing line transversely of the tube and a discontinuous cut line in the form of a continuous wavelike curve positioned transversely of the tube at the middle of the portion defined by each two adjacent sealing lines, so as to provide at least two crest portions at the opening of each of the pair of inner bags to be formed on the opposite sides of the wavelike cut line.

For a better understanding of the present invention, a detailed description will be given below with reference to the accompanying drawing wherein.

Figure 1:
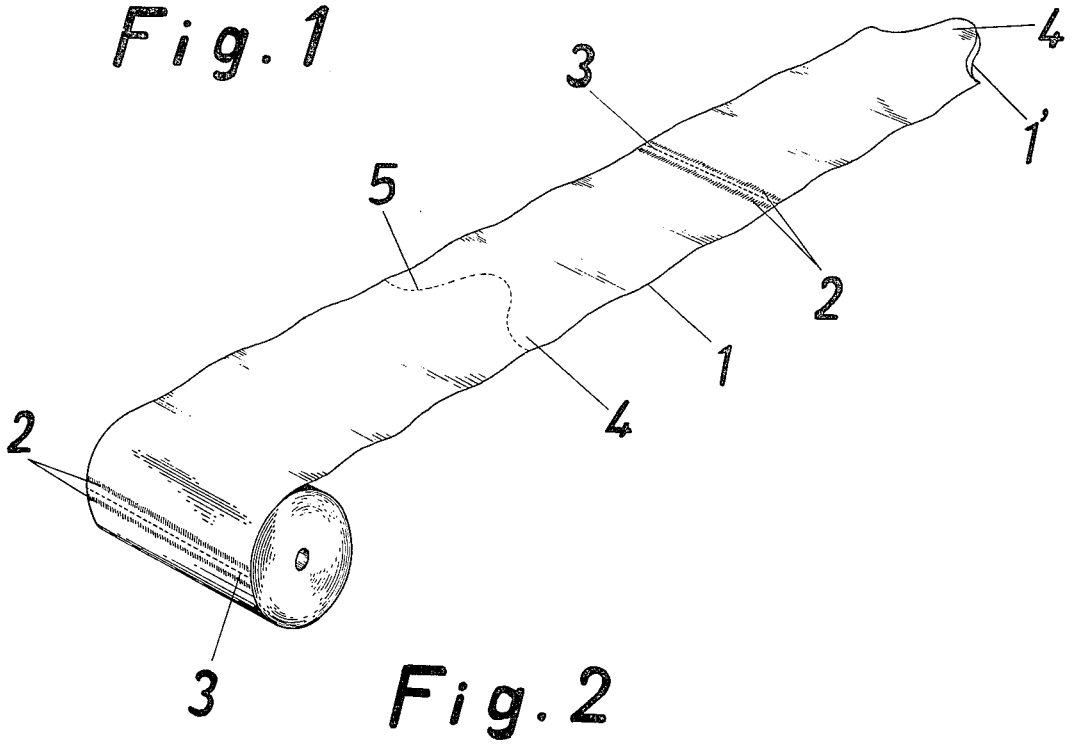
FIG. 1 is a perspective view of an inner tube which has been formed in pairs in the shape of a continuous tube in accordance with this invention.
Figure 3:
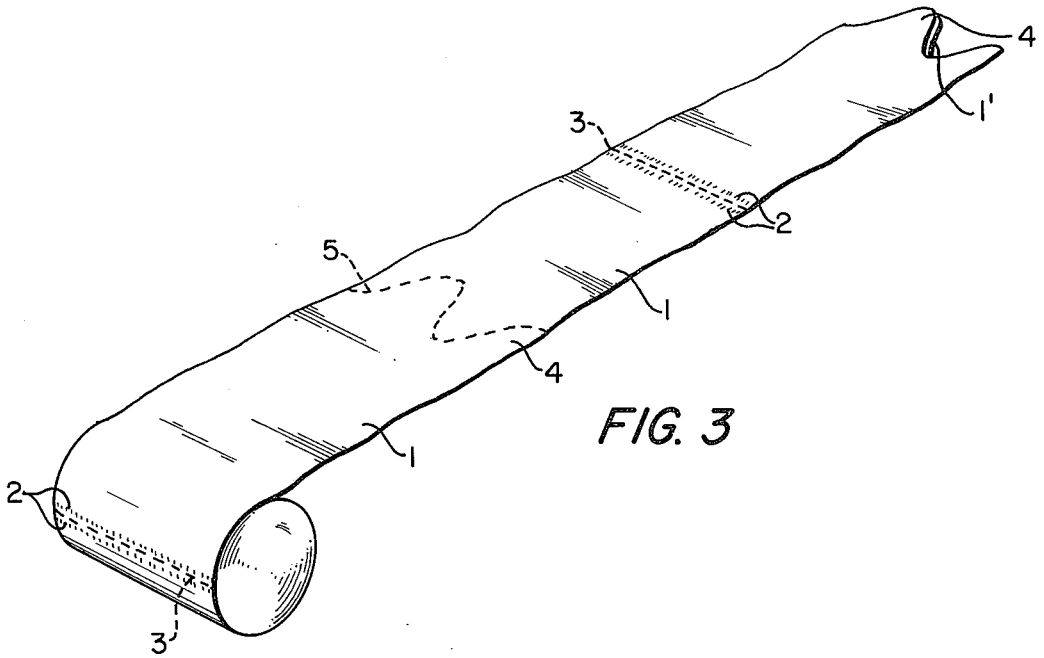
FIGS. 3 and 4 are partial plan views showing wavelike cut lines defining three and four crests, respectively.
Figure 4:
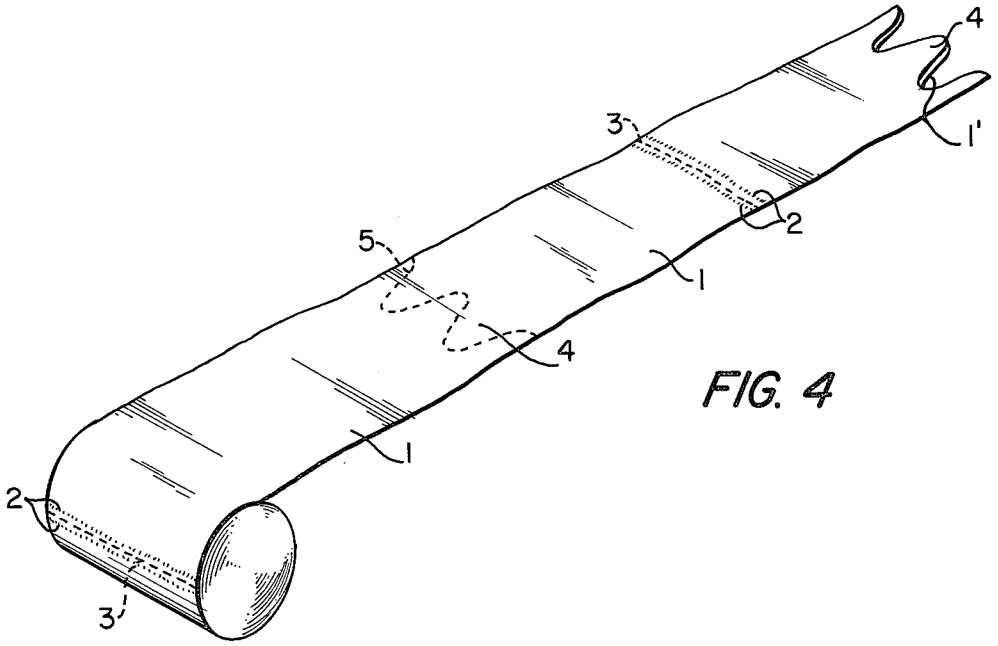

Referring to FIG. 1, an inner bag 1 is made of a plastic tubular material such as a commercial soft polyethylene tube. The tubular material, illustrated in collapsed form in FIG. 1, is formed with sealing lines 2 extending transversely of the tubular material and spaced apart by a predetermined distance longitudinally thereof. At the middle in each sealing line 2 is a cut-off line 3 which is formed by cutting the tubular material in the form of a dashed or perforated line. The distance between the directly adjacent sealing lines 2 is such that the intermediate portion therebetween provides two bags 1 as a unit. Extending at the middle of this portion transversely of the tubular material is a wavelike cut-off line 5 in the form of a dashed or perforated line which defines the openings of a pair of the bags 1 to be formed on its opposite sides. Accordingly, in the illustrated collapsed form before the bags are separated from each other at the cut-off line 5, the bags are positioned as if in meshing engagement with each other. The cut-off line 5 is in such form that when the bag 1 is inflated, two crest portions 4 are formed at the opening of each bag 1. The number of the crest portion 4 may be three to six. FIG. 3 shows three crests and FIG. 4 shows four crests. With respect to the form of periphery 1′ of the opening 1, it is essential that the wavelike cut-off line 5 provide an elongated periphery which is effective in ensuring easy folding and that substantially large crest portions 4 be formed.

Figure 2:
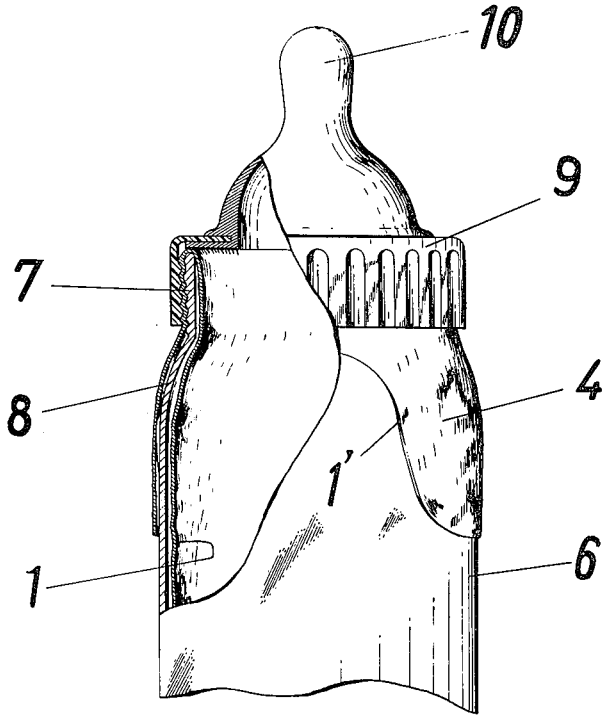
FIG. 2 is a front view showing the inner bag of this invention as it is placed in a nursing bottle with its opening portion folded over the mouth of the bottle and fastened in position.

When the bag 1 thus formed is to be put to use, the bag at an extreme end position is torn off an adjacent bag 1 along the cut-off line 3 or 5. Since the bag 1 thus obtained in accordance with this invention is provided with an opening which has an effective peripheral length, the bag is much easier to fold over the mouth 7 of a nursing bottle 6 than is the case with a conventional bag which has a linear edge at the opening as shown in FIG. 2. Further because the crest portions 4 defined by the opening edge 1′ will be folded over and allowed to extend downward along the shoulder 8 of the nursing bottle 6, the bag can be fastened to the mouth 7 of the nursing bottle by a nipple holding ring 9 along with a nipple 10 while the crest portions 4 are being held against the bottle 6 by the finger. As a result, the upper portion of the bag 1 can be retained in position against rotation with the nipple holding ring 9 to ensure stable fastening effect all the time.

In accordance with the present invention described above, the inner bags 1 are formed in pairs, each with respective edges 1' of the openings in meshing arrangement, in the form of a continuous series of bags from which the bag can be torn off readily and which can be rolled up, so that as compaired with conventional bags which have been produced one by one, a great number of bags can be stored in a compact form at a time and carried about with convenience during travel or when one is away from home. The bags of this invention which can be manufactured in continuous form without wasting any material further ensures low cost and economical use. The inner bag of this invention has another advantage of being sanitary in that it can be kept almost free from germs or dust due to the structure in which the openings edges 1' are interconnected at the wavelike cut-off line 5 in sealing manner.

What is claimed is:

1. An inner bag for a container such as a nursing bottle formed in pairs, said pairs of inner bags being continuous in the shape of an elongated flexible plastic tube and defined by a plurality of sealing lines formed transversely of said tube and spaced apart by a predetermined distance longitudinally of said tube, a discontinuous cut line formed in the middle of each of said sealing lines transversely of said tube and a discontinuous cut line in the shape of a continuous wave-like curve formed transversely of said tube at the middle of the portion defined by each two adjacent spaced apart sealing lines, so as to provide at least two crest portions at the opening of each of said pair of inner bags to be formed on the opposite sides of said wave-like cut line, said inner bags thus being adapted to be separated from each other when torn off along the cut lines, wherein the crests are substantially large with an elongated periphery with an effective peripheral length for folding and, wherein the length of each crest portion in the longitudinal direction of the tube is at least equal to the distance between the troughs defining two crest portions.

2. The inner bag as set forth in claim 1 wherein said wavelike cut line defines three crest portions at the opening of said inner bag.

3. The inner bag as set forth in claim 1 wherein said wavelike cut line defines four crest portions at the opening of said inner bag.

4. An inner bag for a container such as a nursing bottle formed as a plurality of bags in the form of an endless flexible tube on a roll, comprised of a plurality of sealing lines formed transversely of said tube and spaced apart by a predetermined distance longitudinally of said tube, a first discontinuous cut line formed in the middle of each of said sealing lines transversely of said tube and a second discontinuous cut line in the shape of a wave-like curve formed transversely of said tube at the middle of the portion defined by each of two adjacent spaced apart sealing lines, so as to provide at least two crest portions at the opening of said inner bags to be formed on the opposite sides of said wave-like cut lines, said inner bags thus being adapted to be separate from each other when torn off along the cut lines, and wherein the crests are substantially large with an elongated periphery with an effective length for folding and wherein the length of each crest portion in the longitudinal direction of the strip is at least equal to the distance between the troughs defining two crest portions.

* * * * *